US005615588A

United States Patent [19]

Gottschald

[11] Patent Number: 5,615,588

[45] Date of Patent: Apr. 1, 1997

[54] APPARATUS FOR PROCESSING THE EDGE OF OPHTHALMIC LENSES

[75] Inventor: Lutz Gottschald, Meerbusch, Germany

[73] Assignee: Wernicke & Co. GmbH, Dusseldorf, Germany

[21] Appl. No.: 54,282

[22] Filed: Apr. 30, 1993

[30] Foreign Application Priority Data

Apr. 30, 1992 [DE] Germany ..... 42 14 326.8

[51] Int. Cl.[6] ..... B23B 5/00

[52] U.S. Cl. ..... 82/11; 82/142

[58] Field of Search ..... 82/11, 12, 117, 82/142, 147, 165

[56] References Cited

U.S. PATENT DOCUMENTS

| | | | |
|---|---|---|---|
| 3,738,204 | 6/1973 | Spriggs | 82/1.11 |
| 3,745,623 | 7/1973 | Wentorf et al. | 407/119 |
| 3,810,403 | 5/1974 | Ianuzzi et al. | 82/11 |
| 3,909,982 | 10/1975 | Schlotfeldt | 82/12 |
| 4,084,458 | 4/1978 | Galley | 82/11 |
| 4,159,884 | 7/1979 | Schott | 407/113 |
| 4,202,226 | 5/1980 | Becker et al. | 82/12 |
| 4,257,290 | 3/1981 | Scott | 82/165 |
| 4,434,581 | 3/1984 | Spriggs | 82/11 |
| 4,781,452 | 11/1988 | Ace | 451/43 |
| 4,941,291 | 7/1990 | Brueck | 82/170 |
| 4,980,993 | 1/1991 | Umezaki | 451/5 |
| 5,011,515 | 4/1991 | Frushour | 407/119 |
| 5,053,971 | 10/1991 | Wood et al. | 451/43 |
| 5,149,337 | 9/1992 | Watanabe | 451/42 |
| 5,161,333 | 11/1992 | Lecerf et al. | 451/43 |
| 5,257,198 | 10/1993 | Van Schoyck | 451/42 |

*Primary Examiner*—Maurina I. Rachuba
*Attorney, Agent, or Firm*—Antonelli, Terry, Stout & Kraus, LLP

[57] ABSTRACT

An apparatus for processing edges of ophthalmic lenses with a gripping device for the ophthalmic lens. The gripping device grips the ophthalmic lens in such a manner that the edge to be processed in accessible, with a turning the gripping device with the gripped ophthalmic lens turns about an axis of rotation. A tool is held in a support and is brought into contact with an edge area of the ophthalmic lens to be processed for the processing procedure. The tool is a lathe tool, with the support being conveyed by a control unit in at least one direction during a rotation of the gripping device corresponding to a prescribed shape of the ophthalmic lens.

15 Claims, 2 Drawing Sheets

APPARATUS FOR PROCESSING THE EDGE OF OPHTHALMIC LENSES

FIELD OF THE INVENTION

The present invention relates to an apparatus for processing edges of ophthalmic lenses.

BACKGROUND OF THE INVENTION

Edging rough round, that is a lens having both surfaces formed and processed according to prescription or pre-edged ophthalmic lenses, for example, adapting a rough round or pre-edge ophthalmic lens to fit a specific frame shape, is presently done by grinding-processing procedures.

Appropriate apparatus have been proposed which include a gripping device for the ophthalmic lens which grips the ophthalmic lens in such a manner that an edge to be processed is readily accessible. A turning unit slowly rotates the gripping device with the ophthalmic lens about an axis of rotation in such a manner that the entire edge of the ophthalmic lens comes consecutively in contact with a grinding tool. The tool is held in a supporting means and can be brought into contact with the edge area of the ophthalmic lens to be processed for the processing procedure. The grinding tool which, in the simplest form, is a lap which is also held on a shaft which a drive quickly turns. A control unit, which may be a copying control unit or an electronic control unit in which the form to be obtained is stored, brings the ophthalmic lens in contact with the grinding tool with respect to the angle of rotation of the gripping device of the respective ophthalmic lens in such a manner that an edged ophthalmic lens is produced.

Grinding devices on which the above described process is carried out are in use in a large number of optometrists' workshops as well as in central lens production facilities.

Disadvantages of the state of the art grinding devices are that the processing time is relatively long and it is not possible to work on both the edge and surface of the lens without re-chucking the grip and/or readjusting the respective ophthalmic lens, or without changing tools in order to carry out the various edge processing steps with the necessary precision required in a number of cases.

However, especially in central lens production facilities, it has recently become a practice to process the so-called prescription surface, that is, the production of both sides of a finished ophthalmic lens from a so-called blank and the edges of the ophthalmic lens, which previously the optometrist performed.

It is advantageous, particularly in the critical thickness, that is, the center thickness of the lens in a case of lenses having positive power and the thickness of the edge in the lenses having negative power, respectively, is to be minimized, to first pre-edge the delivered blank, for example, an ophthalmic lens finished only on one side, then finish the prescription surface and finally produce the exact contour of the edge including the bevel as well as carry out the de-burring step. This manner of proceeding means that it is necessary to re-grip the ophthalmic lens several times. However, each re-gripping step harbors the danger of errors.

SUMMARY OF THE INVENTION

As object of the present invention is to provide an apparatus for processing the edge of ophthalmic lenses, which will permit rapid fabrication of an edged ophthalmic lens.

A further object of the present invention is to provide an apparatus intended to, if need be, permit carrying out other processing procedure steps, for example, producing a lenti-grind (groove-grind) or decor bevel, a de-burring process and/or a criboperation and, in particular, also processing a surface, such as a prescription surface.

In accordance with the present invention, an apparatus of the aforementioned type is proposed wherein the tool is a lathe tool and the supporting means or support of which a control unit conveys in at least one direction during rotation of the gripping device corresponds to a prescribed shape of the ophthalmic lens, and the processing of the ophthalmic lens ensures in a plurality of rotations of the gripping device.

The present invention is based on the concept of utilizing, instead of grinding procedure, a lathe procedure which has previously not been considered for edging because the contour and the edge, respectively, of the ophthalmic lenses is axially symmetrical only in exception cases.

BRIEF DESCRIPTION OF THE DRAWINGS

The invention will be described in more detail in connection with the accompanying drawings wherein.

DETAILED DESCRIPTION

Figure 1:
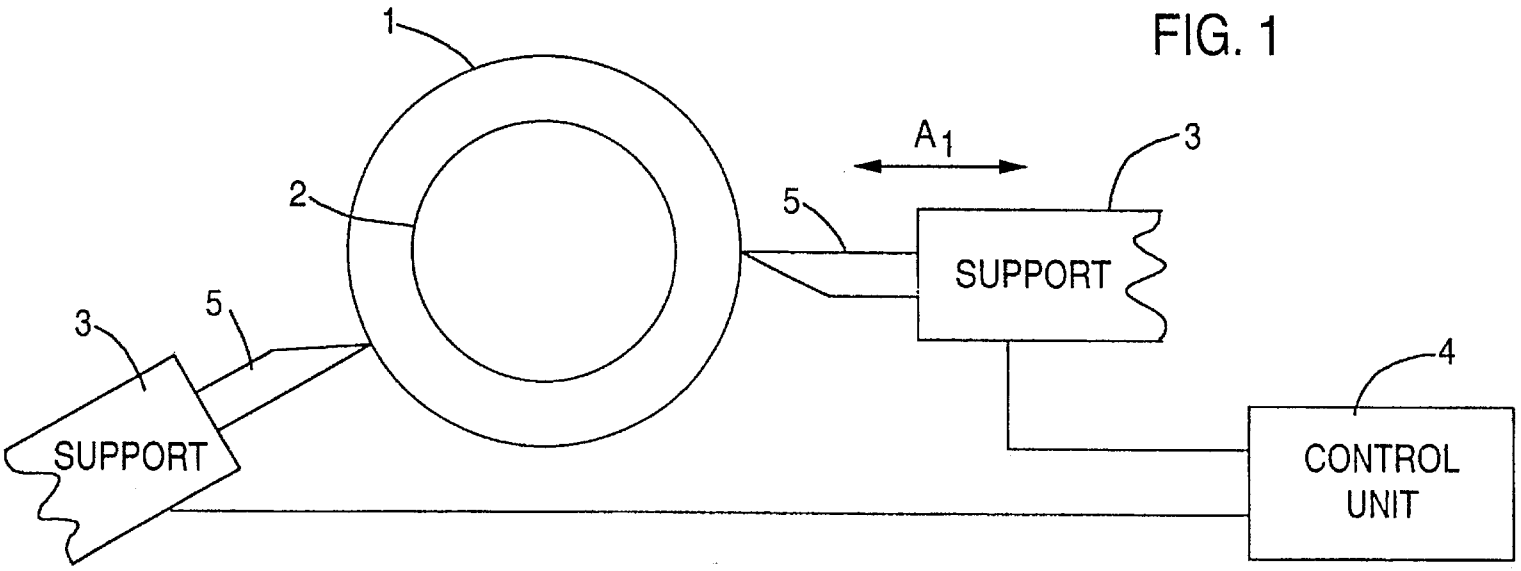
FIG. 1 is a schematic front view of an apparatus for processing edges of an ophthalmic lens in accordance with the present invention.
Figure 2:
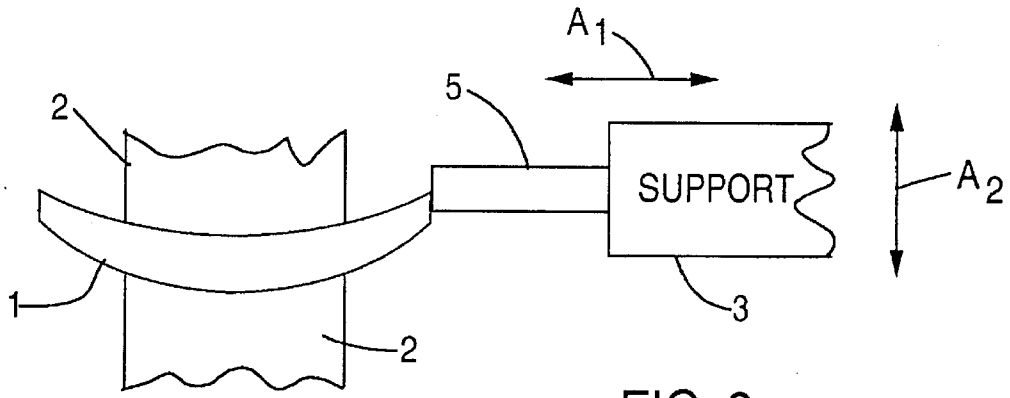
FIG. 2 is a top view of the apparatus of FIG. 1.
Figure 3A:
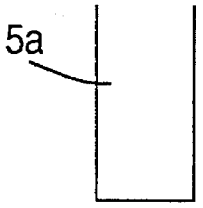
FIGS. 3*a*–3*d* are schematic top views of lathe tools useable in the apparatus of the present invention.
Figure 3B:
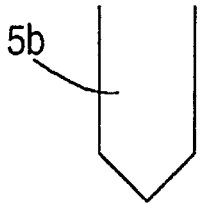
Figure 3C:
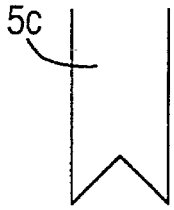
Figure 3D:
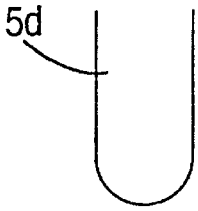

Referring now to the drawings wherein like reference numerals are used throughout the several views to designate like parts and, more particularly, to FIGS. 1 and 2, according to these figures, an apparatus for processing edges of ophthalmic lenses includes a lathe tool 5 mounted on a support 3 controlled by a control unit 4 which, for example, may be a conventional machine control or a PC. The control unit 4 conveys information corresponding to a prescribed shape of an ophthalmic lens 1 in at least one direction during one rotation of a gripping unit or device 2. Unlike conventional grinding procedures, the processing of the ophthalmic lens is carried out during a plurality of rotations of the gripping unit or device 2. In other words, according to the invention, the support 3 is adjusted so quickly that, despite the number of rotations of the workpiece, namely, the ophthalmic lens 1, used for the lathes, if need be, axially unsymmetrical contouring of the workpiece occurs.

Compared with conventional grinding processes which take about ten minutes to contour the lens 1, the lathe process according to the present invention only takes about ten-twenty seconds.

Figure 4A:
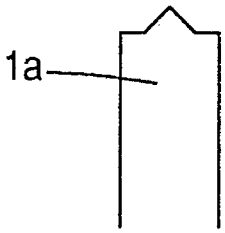
FIGS. 4*a*–4*c* are schematic representations of edges of lens obtained with the present invention.
Figure 4B:
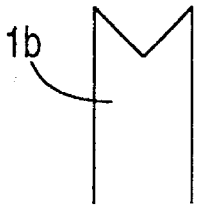
Figure 4C:
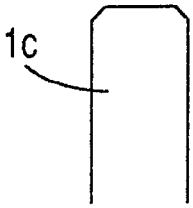

Conventional lathe tools utilized for processing optical surfaces of lenses may be employed as the lathe tools in the apparatus of the present invention. In particular, lathe tools 5*a*, 5*b*, 5*c* or 5*d* may be configured as shown in FIGS. 3*a*–3*d* so as to result in processed edges 1*a*, 1*b*, 1*c* such as illustrated in FIGS. 4*a*–4*c*.

The material of the lathe tool can be selected in the same manner as in other fields, for example, with the blade area of the lathe tool being composed of a hard metal, PKD (polycrystalline diamond) or coated with diamond powder.

In edging of the lens 1, it is particularly advantageous that the gripping unit or device 2 grips both the ophthalmic lens 1 on its front surface as well as on an eye-facing surface thereof. For this purpose, the gripping device 2 may have, for example, two axially movable stamps preferably coated with an elastic material on a front thereof so that a contact surface between the stamps and the lens 1 conforms to the curved surface of the ophthalmic lens 1.

Naturally, other embodiments of the gripping unit or device 2 are also possible as long as they permit free access to the edge of the lens 1 to be processed.

For example, a so-called block (not shown) having a pin-shaped extension with which it can be inserted in a gripping jaw of the gripping device or unit 2 may be applied to a surface of the ophthalmic lens 1.

The gripping device or unit 2 preferably grips the ophthalmic lens 1 on a front surface of the lens 1 approximately in a region of the geometric center of the rough round ophthalmic lens 1 or with the eye-facing surface approximately in the region of an optical axis of the ophthalmic lens 1.

During a rotation of the ophthalmic lens 1, the support 3 of the tool 5 is adjusted in a direction perpendicular to the axis of rotation of the gripping unit or device 2 as shown by the arrow $A_1$ in FIGS. 1 and 2 in correlation with the angle of rotation of the ophthalmic lens in such a manner that the edge of the ophthalmic lens 1 receives the desired contour.

However, the support 3 can also be moved in a direction of the axis of rotation represented by the arrow $A_2$ in FIG. 2 in order to control the position and/or the shape of a bevel on the circumferential edge. In this manner, a controlled position and/or shape of the bevel is obtained especially in the case of ophthalmic lenses 1 having a greatly varied edge, as is the case, for example, with progressive ophthalmic lenses, so that the ophthalmic lens does not extend unevenly over the frame.

The lathe procedure employed in accordance with the present invention has the additional advantage that a rotating procedure also permits processing the optical surface of the ophthalmic lens 1, for example, production of the so-called prescription surface. In this manner both the spherical and aspherical surfaces, including axially symmetrical surfaces or astigmatic surfaces can be produced. In this manner, in particular, processing the edge of the lens 1 and processing the surface can be carried out in the same apparatus.

Figure 5:
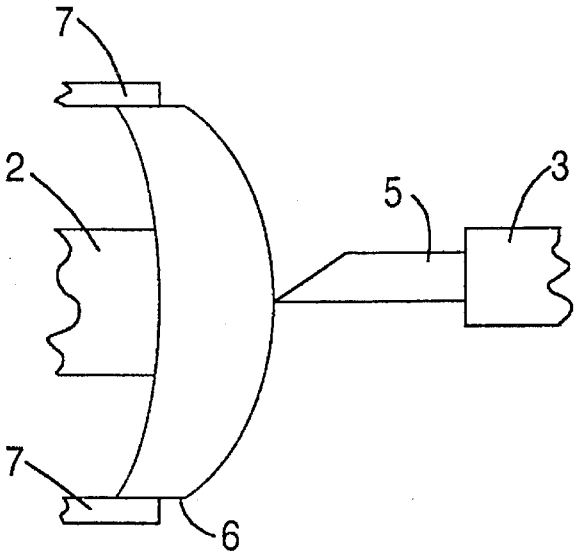
FIG. 5 is a schematic view of an edge gripping arrangement for a lens in an apparatus constructed in accordance with the present invention.

In this event, it is particularly preferably if the gripping device or unit 2 is constructed in such a manner that the ophthalmic lens 1 can be gripped selectively at the circumferential edge or at the surface so that the surfaces and the circumferential edge can be consecutively processed. For example, the gripping device may have a stamp or lathe chuck for a block to support the ophthalmic lens 1 at its surface and, in addition, at least three equally circumferentially spaced extendable gripping jaws 7, only two of which are shown in FIG. 5 for the sake of clarity, for chucking the ophthalmic lens 1 at the circumferential edge. In the embodiment the ophthalmic lens 1 can be gripped or chucked alternately at its surface and at its circumferential edge. During the re-chucking procedure both gripping jaws 7 and gripping unit or device 2 can grip the ophthalmic lens 1 in such a manner that the position of the ophthalmic lens 1 cannot change with respect to the apparatus and, in particular, with respect to the support 3 of the tools 5.

It is also possible in accordance with the present invention to process the edges of the ophthalmic lenses 1 with several lathe tools 5 being provided along the edge as shown in FIG. 1, which either perform the same processing procedure so that the processing velocity is increased or are formed for various tasks, for the production of lenti-grind or groove-grind (FIG. 4*b*), a decor bevel (FIG. 4*a*), a de-burring procedure (FIG. 4*c*) and/or a crib operation.

On the basis of the preceding description, for someone skilled in the art of the tool machine construction, the present invention can be realized. In any event, however, a universal utilizable apparatus for processing ophthalmic lenses is obtained by the features of the present invention described hereinabove.

What is claimed is:

1. An apparatus for processing edge areas of an ophthalmic lens, the apparatus comprising:

a gripping device for gripping the ophthalmic lens in such a manner that the edge area of the ophthalmic lens to be processed is accessible, a turning device for turning said gripping device with the gripped ophthalmic lens about an axis of rotation, a support, a lathe tool supported by the support and adapted to be brought into contact with the edge area of said ophthalmic lens to be processed for effecting a processing operation, and a control unit for controlling the support and for conveying the lathe tool towards and away from the ophthalmic lens in a direction perpendicular to the axis of rotation during a rotation of said gripping device corresponding to an axially unsymmetrical circumferential contour of said ophthalmic lens, and wherein said ophthalmic lens is processed by said lathe tool during a plurality of rotations of said gripping device.

2. An apparatus according to one of claims 1, wherein said lathe tool is a lathe chisel.

3. An apparatus according to one of claims 1 or 2, wherein a cutting area of said lathe tool is fashioned of a hard metal.

4. An apparatus according to one of claims 1 or 2 wherein a cutting area of said lathe tool is provided with a diamond powder coating.

5. An apparatus according to one of claims 1 or 2, wherein, in processing said edge area of said ophthalmic lens, said gripping device grips said ophthalmic lens on a front surface and an eye-facing surface of said ophthalmic lens approximately in an area of the geometric center of said ophthalmic lens.

6. An apparatus according to one of claims 1 or 2, wherein, in processing said edge area of said ophthalmic lens said gripping device grips said ophthalmic lens on a front surface and an eye-facing surface of said ophthalmic lens approximately in an area of an optical axis of said ophthalmic lens.

7. An apparatus according to one of claims 1 or 2, wherein, in processing said edge area of said ophthalmic lens, said control unit also moves said support of said lathe tool in a direction of said axis of rotation for controlling the at least one of a position and shape of a bevel on the edge area of the lens.

8. An apparatus according to one of claims 1 or 2, wherein said gripping device is adapted to one of selectively chuck said ophthalmic lens at the edge area or grip the lens at opposite surfaces of the lens in such a manner that both surfaces and the edge area can be consecutively processed.

9. An apparatus according to claim 8, wherein said gripping device includes at least three extendable jaws for enabling a chucking of the ophthalmic lens.

10. An apparatus according to one of claims 1 or 2 wherein, in processing the edge area of said lens, a plurality of lathe tools are provided along the edge area of the lens.

11. An apparatus according to claim 10, wherein at least one of said lathe tools is profiled corresponding to respective processing procedures of the respective lens.

12. An apparatus according to one of claims 1 or 2, wherein said control unit controls said lathe tool to produce a lenti-grind.

13. Apparatus according to claim 3, wherein a cutting area of said lathe tool is fashioned of a polycrystalline diamond.

14. An apparatus according to one of claims 1 or 2, wherein said control unit controls said lathe tool to produce a de-burring step.

15. An apparatus according to one of claims 1 or 2, wherein said control unit controls said lathe tool to produce a cribbing of the edge area of the ophthalmic lens.

* * * * *